US006631575B1

(12) United States Patent
Voelzke et al.

(10) Patent No.: US 6,631,575 B1
(45) Date of Patent: Oct. 14, 2003

(54) LED AND LIGHT DIFFUSER FOR A LIGHTED SIGN

(75) Inventors: Vernon P. Voelzke, Brookings, SD (US); Eric S. Bravek, Brookings, SD (US); Randy Scott Uehran, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 09/927,149

(22) Filed: Aug. 10, 2001

Related U.S. Application Data

(63) Continuation-in-part of application No. 09/708,988, filed on Nov. 8, 2000.

(51) Int. Cl.[7] ..... G09F 3/04
(52) U.S. Cl. ..... 40/451; 40/550
(58) Field of Search ..... 40/451, 544, 570, 40/550

(56) References Cited

U.S. PATENT DOCUMENTS 1,944,276 A * 1/1934 Schepmoes ..... 40/570
2,230,152 A * 1/1941 Wolfrey ..... 40/451
4,724,629 A * 2/1988 Walton ..... 40/541
5,611,163 A * 3/1997 Smith ..... 40/570
5,678,336 A * 10/1997 Jue et al. ..... 40/570
5,685,098 A * 11/1997 Wegrzyn ..... 40/570
6,092,318 A * 7/2000 Arie et al. ..... 40/547

OTHER PUBLICATIONS

Acrylite df, CYRO Industries, No date.*

* cited by examiner

*Primary Examiner*—Joanne Silbermann
(74) *Attorney, Agent, or Firm*—Hugh D. Jaeger

(57) ABSTRACT

An LED lighted sign with a light diffuser sheet with embedded diffusion particles which provides a 20%–40% increase in lighting transmittance. There is also provided a light divider assembly having partitions which serve to segregate groups of LEDs for lighting only selected segments of the light divider assembly for displaying numerical images. Alternatively, there is provided an injection molded light diffuser lens of the same material which secures to each of several light diffuser chambers which combine to display numerical images. optionally, colored LEDs may be used to create color displays. Color filters may also be overlaid the light diffusers or color pigment may be added to the diffusion material during injection molding to create color displays. A molded light divider assembly is also provided in the alternative.

10 Claims, 11 Drawing Sheets

LED AND LIGHT DIFFUSER FOR A LIGHTED SIGN

CROSS REFERENCES TO CO-PENDING APPLICATIONS

This patent application is a continuation-in-part of Ser. No. 09/708,988 entitled "LED and Light Diffuser for a Lighted Sign" filed on Nov. 8, 2000, pending.

BACKGROUND OF THE INVENTION

FIELD OF THE INVENTION

The present invention is for an LED lighted sign with a light diffuser.

SUMMARY OF THE INVENTION

The general purpose of the present invention is an LED lighted sign with a light diffuser.

According to one embodiment of the present invention, there is provided an LED lighted sign with a light diffuser sheet with embedded diffusion particles which provides a 20%–40% increase in lighting transmittance. There is also provided a one-piece light divider assembly having partitions which serve to segregate groups of LEDs for lighting only selected segments or bars of the light divider assembly for displaying numerical images optionally, color filters or color pigment may also be added atop or to the diffuser material to provide for colored numerical displays. Alternatively, a colored display can be created by using colored LEDs.

According to another embodiment, there is provided a one-piece light divider assembly which is comprised of separate individual chambers, each with light diffuser lenses which are created by injection molding using the same diffuser material, as previously described. When multiple chambers of the light divider assembly are used in conjunction thereto, numerical images are displayed.

Yet another embodiment provides for a one-piece light divider assembly which is comprised of separate individual chambers having recesses for accommodation of individual diffuser lenses which flush mount individually in the upper region of the light divider assembly.

Still another embodiment provides for a one-piece light divider assembly which is comprised of separate individual chambers having recesses for accommodation of individual diffuser lenses which snappingly engage and flush mount individually in the upper region of the light divider assembly.

All the one-piece light divider assemblies and the separate individual chambers may be made by injection molding, casting, metal forming, welding, or other appropriate means.

One significant aspect and feature of the present invention is a light diffuser sheet or lens which increases the light transmittance 20%–40%, while producing a uniformly lighted segment or bar.

Another significant aspect and feature of the present invention is a light divider assembly which allows for selected segments or bars of the display to be illuminated.

Still another significant aspect and feature of the present invention is the provision of optional color pigment or color filters added atop or to the diffuser material which will change the color of the emitted light.

Yet another significant aspect and feature of the present invention is the provision of colored LEDs with a clear light diffuser sheet or injection molded diffuser lens of the same material which will allow the emitted light to be any color.

Another significant aspect and feature of the present invention is a one-piece light divider assembly having partitions which serve to segregate groups of LEDs for lighting only selected segments of the light divider assembly.

Another significant aspect and feature of the present invention is a light divider assembly which is comprised of separate individual chambers, each with light diffuser lenses which snappingly engage the light divider assembly.

Another significant aspect and feature of the present invention is a one-piece light divider assembly which is comprised of separate individual chambers having recesses for accommodation of individual diffuser lenses which flush mount individually in the upper region of the light divider assembly.

Another significant aspect and feature of the present invention is a one-piece light divider assembly which is comprised of separate individual chambers having recesses for accommodation of individual diffuser lenses which flush mount individually in the upper region of the light divider assembly. Each individual diffuser lens includes ramped tabs which flex the panels of the light divider assembly outwardly to gain access and to snappingly engage ramped tab receivers in the light divider assembly.

Having thus described embodiments of the present invention and enumerated significant aspects and features thereof, it is the principal object of the present invention to provide an LED lighted sign with a light diffuser sheet or an injection molded lens of the same material.

One object of the present invention is to provide a means for segregating light segments.

Another object of the present invention is to provide a light diffuser sheet or light diffuser lens which increases the lighting transmittance 20%–40% while producing a uniformly lighted segment or bar.

Yet another object of the present invention is to provide a means for easily changing the color of the display.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
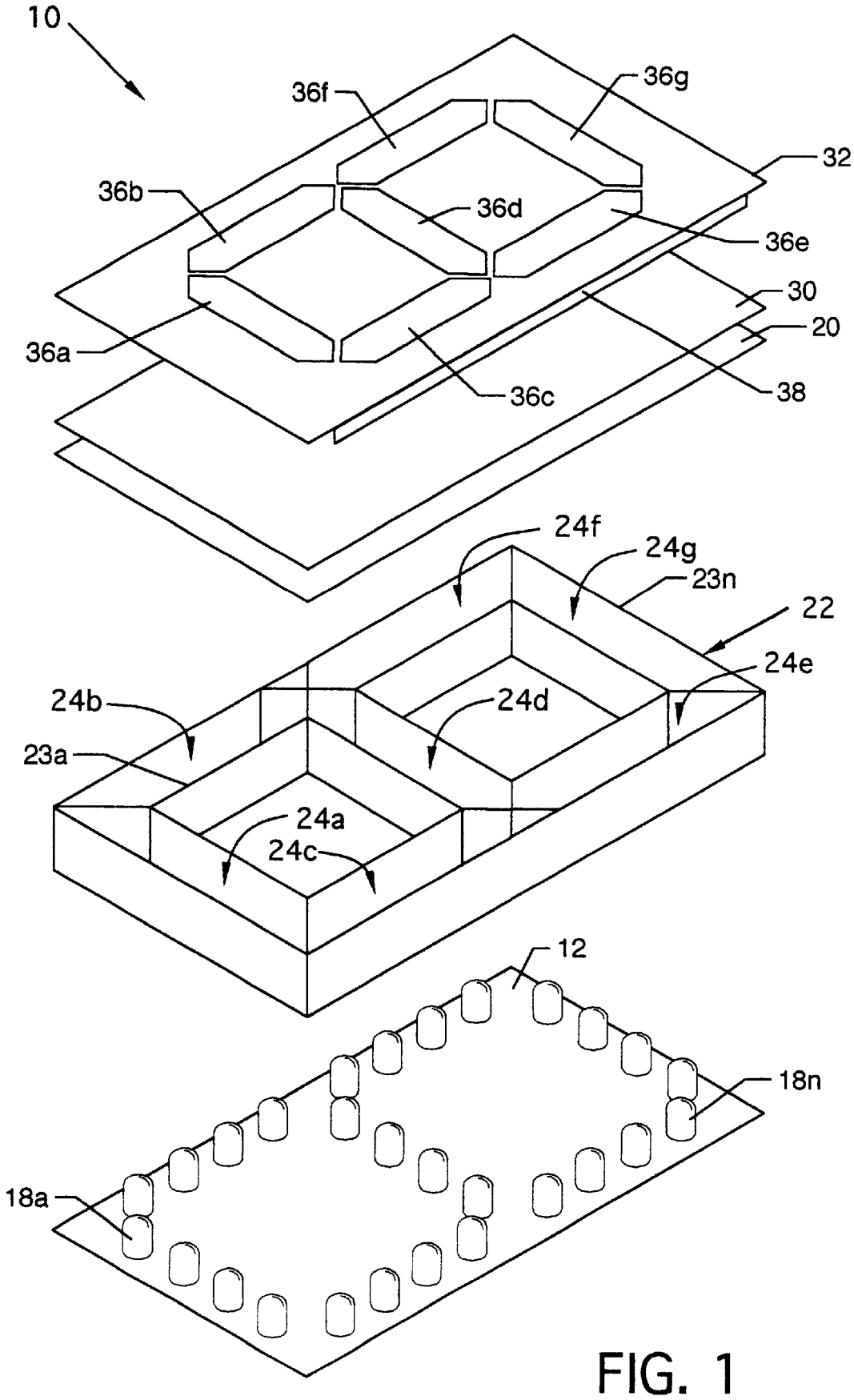
FIG. 1 illustrates an exploded isometric view of an LED lighted sign with a light diffuser, the present invention.
Figure 2:
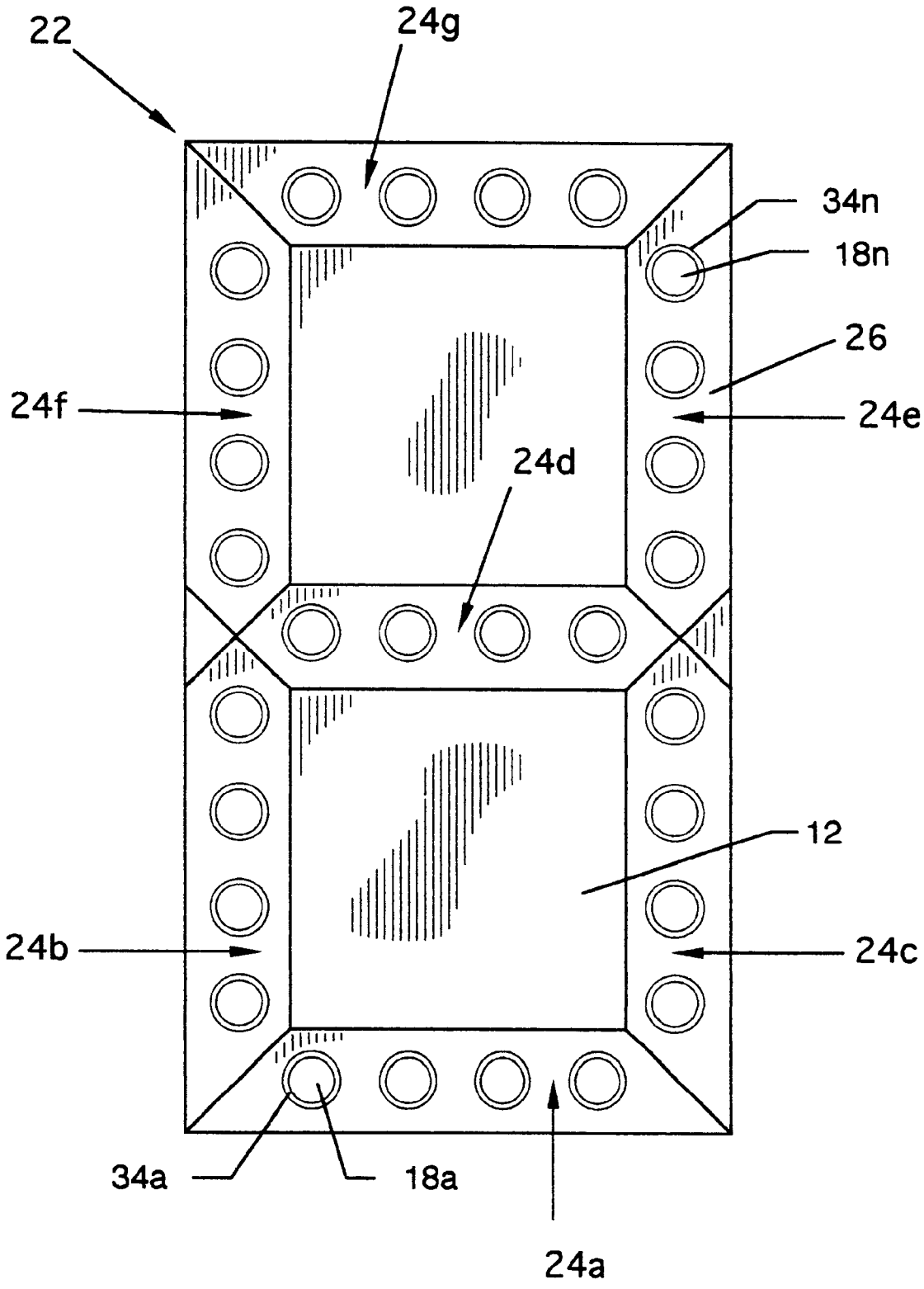
FIG. 2 illustrates a front view of the light divider assembly and the PC board with LEDs projecting therefrom.

FIG. 1 illustrates an exploded isometric view of an LED lighted sign 10 with a light diffuser sheet 20, the present invention. The LED lighted sign 10 comprises a PC board 12, a light divider assembly 22, a light diffuser sheet 20, an optional color filter 30, and a face plate 32. The PC board 12 accepts any number of LEDs 18*a*–18*n* which are soldered to its upper surface. It is to be understood that the PC board 12 accepts any number of LEDs enumerated as LEDs 18*a*–18*n*. The light divider assembly 22 comprises a base 26 (FIG. 2) substantially in the form of a figure eight and a plurality of partitions 23*a*–23*n* upstanding from the base 26 which along with the base 26 form seven geometric chambers 24*a*–24*g*. The base 26 of light divider assembly 22 contains a plurality of apertures 34*a*–34*n* corresponding in number and orientation to the LEDs 18*a*–18*n* projecting from the PC board 12, as shown in FIG. 2. Light diffuser sheet 20 is aligned over the top of light divider assembly 22. The light diffuser sheet 20 gives a 20%–40% increase in lighting transmittance. The light diffuser sheet 20 is a polymer such as, but not limited to, Acrylite® df made by Cyro Industries. Acrylite® df light diffusing molding and extrusion compounds are acrylic polymers with superior light diffusion and transmittance, resulting in higher light intensity and output ratio compared to conventional pigment-diffusion polymers. This offers increased lighting efficiency with a 20–40% increase in light transmittance versus pigmented products. The special optical properties are obtained by incorporating spherical, high molecular weight polymer beads with a different refractive index into the acrylic matrix. The difference in refractive indices changes the direction of light travel within the manufactured part. The net result is an even distribution of light exiting the part.

Alternatively, the Acrylite® df may be injection molded into a lens configuration which may or may not be pigmented for a color display. Acrylite® df exhibits very minimal, if any, color shift when viewed from the side and has a low contrast to its background when in the off state compared to traditional light diffusers, which have significant color shift, and reflects ambient light to the point of looking illuminated. Other light diffuser sheets with similar properties may be used without changing the purpose or scope of the invention. A technical data sheet pertaining to Acrylite® df is attached as Appendix 1 and incorporated herein by reference. An optional color filter 30, in any desired color, can be placed over light diffuser sheet 20. The color filter 30 is not necessary, but it is to be understood that the color filter 30 provides the capability of changing the color of the emitted light easily. Without compromising transmittance, the LED lighted sign 10 has a face plate 32 having seven geometric cutouts 36*a*–36*g* corresponding to the seven geometric chambers 24*a*–24*g* which allow light to be passed through. The face plate 32 has a rectangular lip 38 which fits about the outer perimeter of the light divider assembly 22. The components of the LED lighted sign 10 may be assembled and secured by nuts and bolts, an appropriate adhesive, or welding.

FIG. 2 illustrates a front view of the light divider assembly 22 and the PC board 12 with the LEDs 18*a*–18*n* projecting therefrom, where all numerals correspond to those elements previously described. Illustrated in particular is the plurality of apertures 34*a*–34*n* in the base 26 which correspond in number and orientation to the LEDs 18*a*–18*n* shown projecting from the PC board 12. The one-piece light divider assembly 22 has a plurality of planar partitions 23*a*–23*n* forming the seven geometric chambers 24*a*–24*g* which separate the light emitted by the sets of LEDs 18*a*–18*n*, respectively, in each geometric chamber 24*a*–24*g*. The light divider assembly 22 may be made by injection molding, casting, metal forming, welding, or other appropriate means. Four LEDs are depicted for each geometric chamber 24*a*–24*g*, but any number of LEDs could be provided, the number provided being dependent on the size of the individual geometric chambers. The LEDs of each set are disposed in a line for forming a segment or bar of a numeric display. By lighting the LEDs in only selected geometric chambers 24*a*–24*g*, a numeric display can be achieved ranging from zero to nine. The LED lighted sign 10 can be used in a scoreboard, a clock, a timer, or any other application which requires a numeric digit display.

Figure 3:
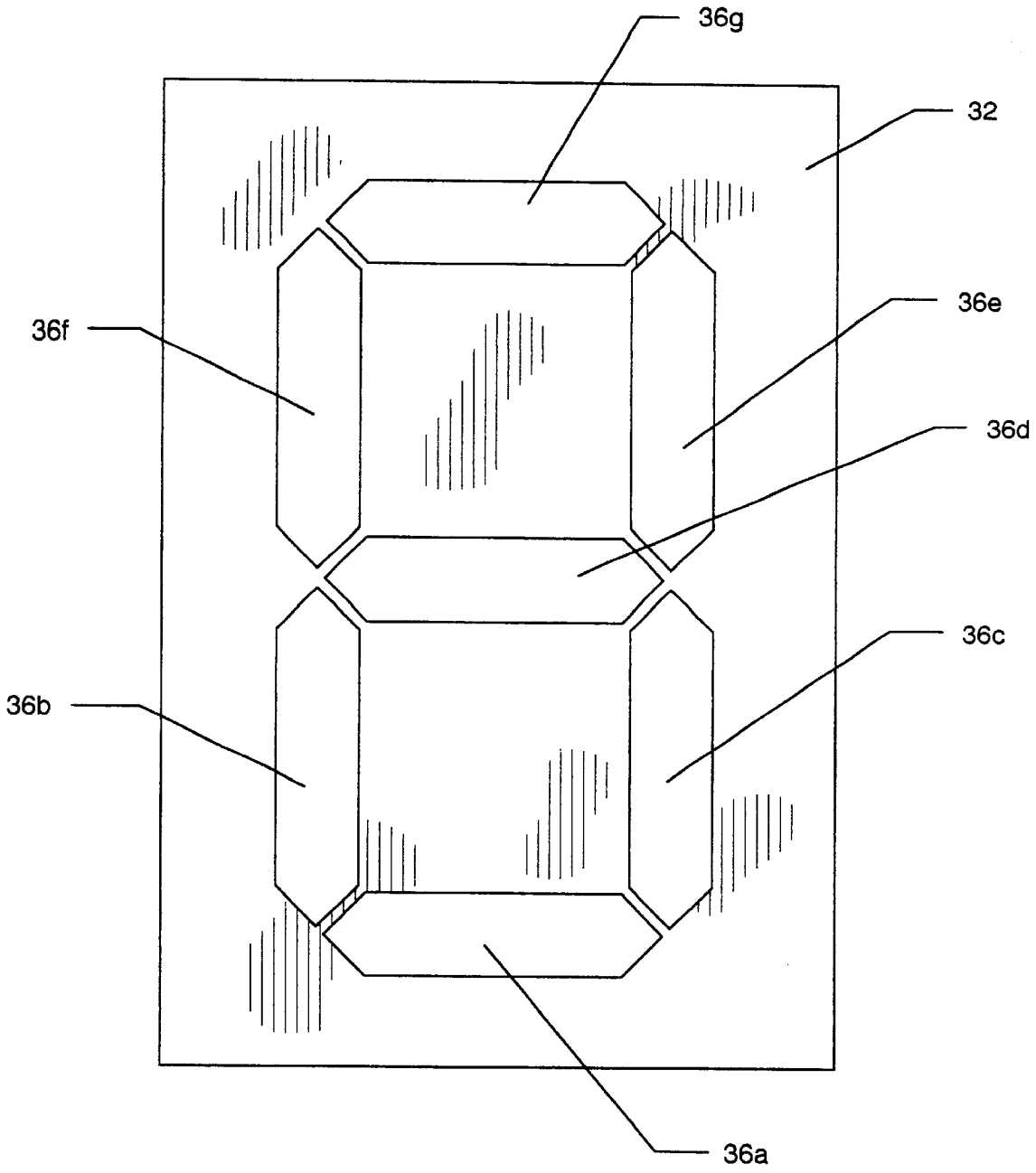
FIG. 3 illustrates a front view of the face plate.

FIG. 3 illustrates a front view of the face plate 32, where all numerals correspond to those elements previously described. Illustrated in particular is the layout of the geometric cutouts 36*a*–36*g* which allow different numeric displays when the LEDs in different geometric cutouts are illuminated.

Figure 4:
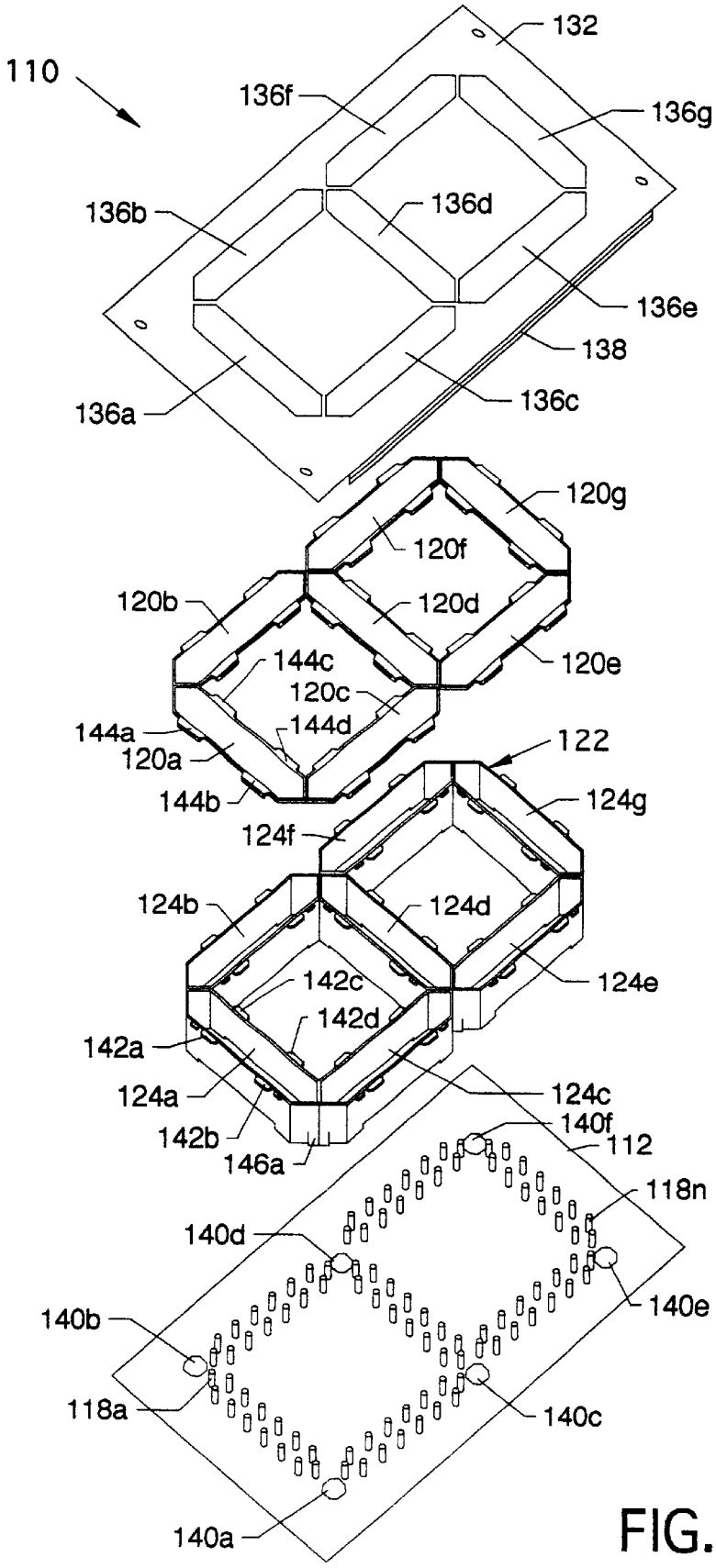
FIG. 4, a first alternative embodiment, illustrates an exploded isometric view of an LED lighted sign with light diffuser lenses covering segmented geometric chambers.

FIG. 4 illustrates an exploded isometric view of a LED lighted sign 110 with light diffuser lenses 120*a*–120*g* covering segmented geometric chambers 124*a*–124*g*, the first alternative embodiment. The LED lighted sign 110 comprises a PC board 112, a light divider assembly 122 comprised of a plurality of segmented geometric chambers 124*a*–124*g*, a plurality of light diffuser lenses 120*a*–120*g*, and a face plate 132 having a plurality of geometric cutouts 136*a*–136*g*. The PC board 112 has a plurality of LEDs 118*a*–118*n* appropriately wired and secured thereto. The LEDs 118*a*–118*n* are oval in shape with varying beam spread in two directions which allows positioning of the LEDs 118*a*–118*n* to distribute the light in the most efficient manner to achieve uniform lighting of the geometric cutouts 136*a*–136*g* of face plate 132. It is to be understood that any number of LEDs 118*a*–118*n* may be used to accommodate varying light intensity requirements. The light divider assembly 122 is comprised of seven individual geometric chambers 124*a*–124*g*, each having like components. Each geometric chamber 124*a*–124*g*has four protruding tabs 142*a*–142*d*, as exemplified about the geometric chamber 124*a*, extending outwardly from the upper lip of each of the geometric chambers 124*a*–124*g*. There are also provided four flexible locking tabs 146*a*–14*d* which extend downwardly from the lower edge of each geometric chamber 124*a*–124*g* and snappingly engage in apertures 140*a*–140*f* of PC board 112, once properly aligned and positioned over LEDs 118*a*–118*n*. For purposes of brevity and clarity, only flexible locking tab 146*a* associated with geometric chamber 124*a* is specifically identified in FIG. 4. Geometric chamber 124*a* and all of the flexible locking tabs 146*a*–146*d* will be described in detail with reference to FIGS. 5 and 6. It is to be understood that geometric chambers 124*b*–124*g* are identical to geometric chamber 124*a* in function and form. Geometric chambers 124*a*–124*g* can be made by injection molding, casting, metal forming, welding, or other appropriate means.

Light diffuser lenses 120*a*–120*g* are now described in detail. The light diffuser lenses 120*a*–120*g* are injection molded and are made of the same material as the light diffuser sheet 20 of the preferred embodiment. Each light diffuser lens 120*a*–120*g* incorporates four flexible tab receivers 144*a*–144*d* which extend downwardly from their edges. The flexible tab receivers 144*a*–144*d* snappingly engage protruding tabs 142*a*–142*d* and secure the light diffuser lens 120*a* to the geometric chamber 124*a*. Optionally, the light diffuser lenses 120*a*–120*g* may be pigmented in the injection molding process to allow any color of light to be emitted. For purposes of brevity and clarity, only the flexible tab receivers 144*a*–144*d* associated with light diffuser lens 120*a* are specifically identified in FIG. 4. Light diffuser lens 120*a* will be further described in detail with reference to FIGS. 5 and 6. Light diffuser lenses 120*b*–120*g* are identical to light diffuser lens 120*a* in function and form. The face plate 132 of the LED lighted sign 110 has seven geometric cutouts 136*a*–136*g* corresponding to the seven geometric chambers 124*a*–124*g* mounted to the PC board 112 which allow light to pass through and create a numeric display when select geometric chambers 124*a*–124*g* are illuminated. There is provided a rectangular lip 138 which extends downwardly from the underside perimeter of face plate 132 which fits intimately over and about the perimeter of the light divider assembly 122. The components of the LED lighted sign 110 may be assembled and secured by nuts and bolts, screws, an appropriate adhesive, or welding.

Figure 5:
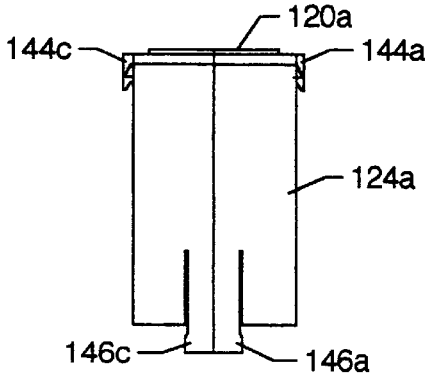
FIG. 5 illustrates an end view of a geometric chamber with a light diffuser lens snappingly engaged thereto.
Figure 6:
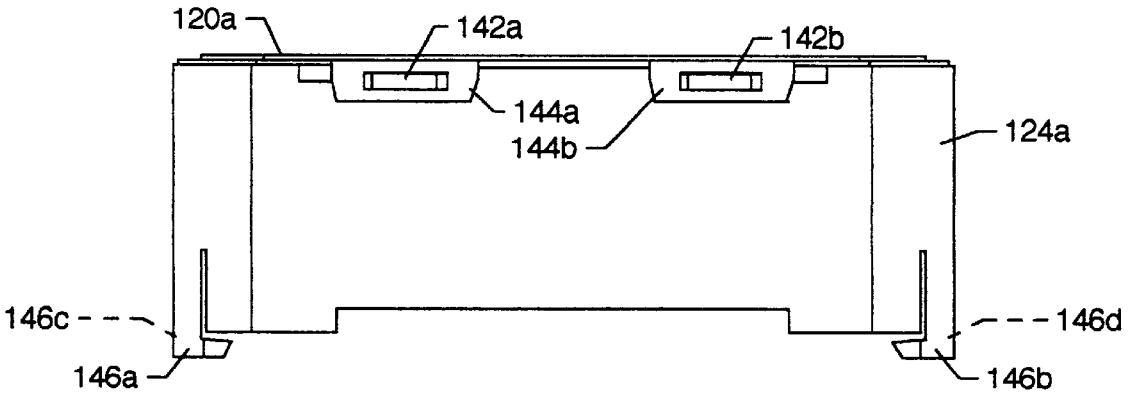
FIG. 6 illustrates a side view of a geometric chamber with a light diffuser lens snappingly engaged thereto.

FIG. 5 illustrates an end view of geometric chamber 124*a* with light diffuser lens 120*a* snappingly engaged thereto, and FIG. 6 illustrates a side view of geometric chamber 124*a* with light diffuser lens 120*a* secured thereto, where all numerals correspond to those elements previously described. With additional reference to FIG. 4, the geometric chamber 124*a* and light diffuser lens 120*a* are now described in detail. Illustrated in particular is the alignment and snapping engagement of the protruding tabs 142*a*–142*d* in conjunction with the flexible tab receivers 144*a*–144*d* and the configuration of the flexible locking tabs 146*a*–146*d* which snappingly engage apertures 140*a*–140*f* when two to three geometric chambers 124*a*–124*g* are perpendicularly aligned as illustrated in FIG. 4. Also illustrated in particular is the light diffuser lens 120*a* which aligningly extends upwardly and is accommodated by the geometric cutouts 136*a*–136*g* where the light diffuser lens 120*a* extends up to or above the plane of face plate 132.

Figure 7:
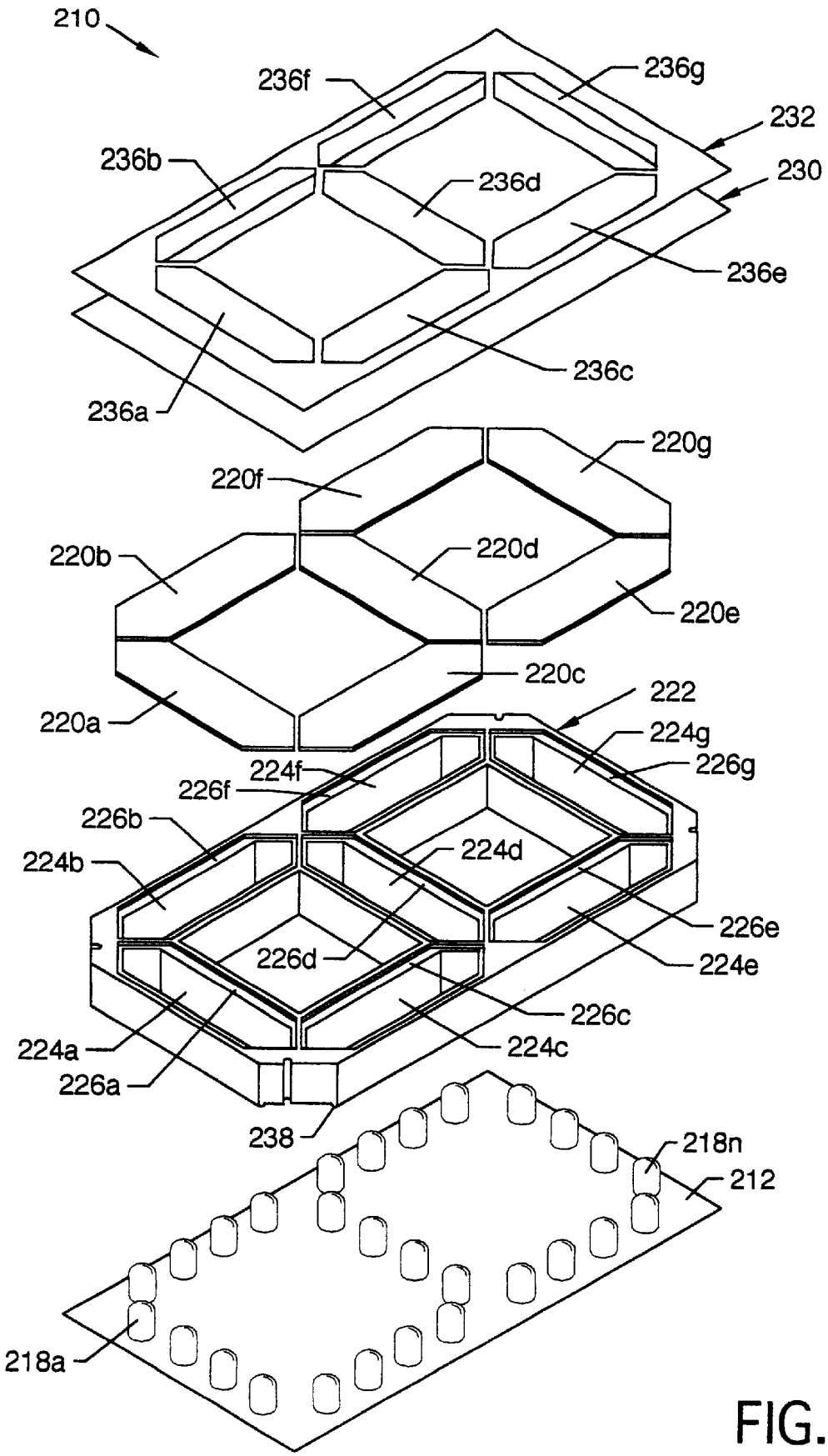
FIG. 7, a second alternative embodiment, illustrates an exploded isometric view of an LED lighted sign with individual light diffuser lenses which align to segmented geometric chambers.

FIG. 7 illustrates an exploded isometric view of an LED lighted sign 210 with individual light diffuser lenses 220*a*–220*g* which align to segmented geometric chambers 224*a*–224*g*, the second alternative embodiment. The LED lighted sign 210 comprises a PC board 212, a light divider assembly 222, preferably vacuum formed or extruded polymer material or molded of foam, plastic, metal or other suitable reflective or suitably colored material, comprised of a plurality of segmented geometric chambers 224*a*–224*g*, a plurality of light diffuser lenses 220*a*–220*g*, a face plate 232 having a plurality of geometric cutouts 236*a*–236*g*, and a color filter 230. The PC board 212 has a plurality of LEDs 218*a*–218*n* appropriately wired and secured thereto. It is to be understood that any number of LEDs 218*a*–218*n* may be used to accommodate varying light intensity requirements. The light divider assembly 222 is comprised of seven individual geometric chambers 224*a*–224*g*, each having like components. A segmented lip 238 is located along the bottom edges of the light divider assembly 222 and as such provides for alignment of the light divider assembly 222 with the edges of the PC board 212. A recess 226*a* is located along and about the upper region of the geometric chamber 224*a* to accommodate light diffuser lens 220*a*. Light diffuser lens 220*a* aligns in the recess 226*a* and is flush with the upper surface of the light divider assembly 222. Similarly shaped recesses 226*b*–226*g* are located along and about the upper region of the geometric chambers 224*b*–224*g* to accommodate light diffuser lenses 220*b*–220*g* in a similar fashion. Geometric chambers 224*a*–224*g* of the light divider assembly 222 can be made by injection molding, casting, metal forming, welding, or other appropriate means.

Light diffuser lenses 220*a*–220*g* are now described in detail. The light diffuser lenses 220*a*–220*g*, which are individual members, can be injection molded or otherwise formed and are made of the same material as the light diffuser sheet 20 of the preferred embodiment. Optionally, the light diffuser lenses 220*a*–220*g* may be pigmented in the injection molding process to allow any color of light to be emitted. In the alternative, a light diffuser sheet 20 of the preferred embodiment can be placed over the upper surfaces of the light divider assembly 222 in substitution for the light diffuser lenses 220*a*–220*g*. The face plate 232 of the LED lighted sign 210 has seven geometric cutouts 236*a*–236*g* corresponding to the seven geometric chambers 224*a*–224*g* which mount to the PC board 212 which allow light to pass through and create a numeric display when select geometric chambers 224*a*–224*g* are illuminated. The components of the LED lighted sign 210 may be assembled and secured, depending on the materials used, by nuts and bolts, screws, an appropriate adhesive, or welding.

Figure 8:
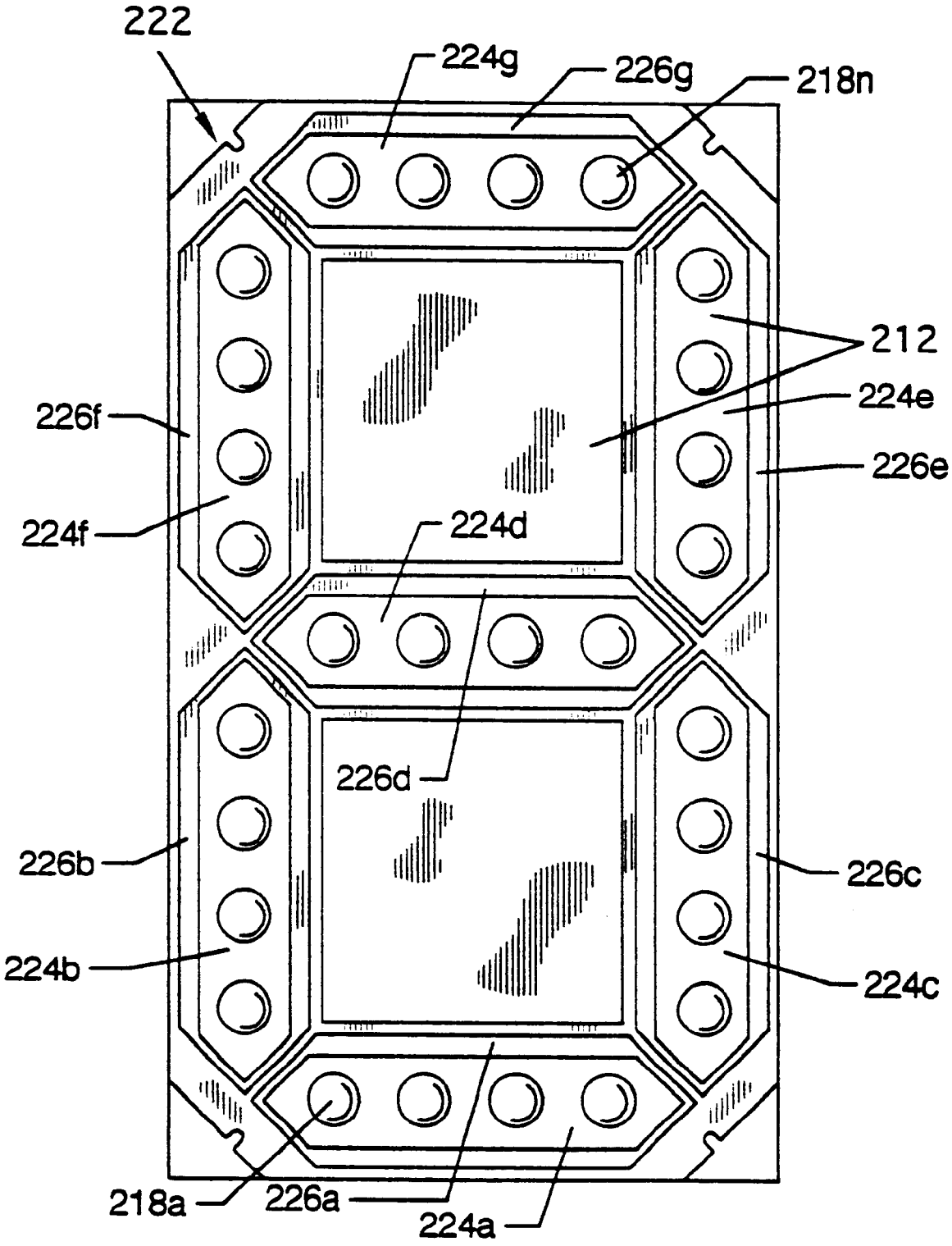
FIG. 8 illustrates a front view of the light divider assembly and PC board including LEDs of FIG. 7.

FIG. 8 illustrates a front view of the light divider assembly 222 and PC board 212 including LEDs 218*a*–218*n*. Shown in particular are the recesses 226*a*–226*g* located along and about the upper regions of the geometric chambers 224*a*–224*g*, respectively, for accommodation of the light diffuser lenses 220*a*–220*g*. Also shown is the alignment of the LEDs 218*a*–218*n* extending upwardly from the PC 212 board into the respective geometric chambers 224*a*–224*g*.

Figure 9:
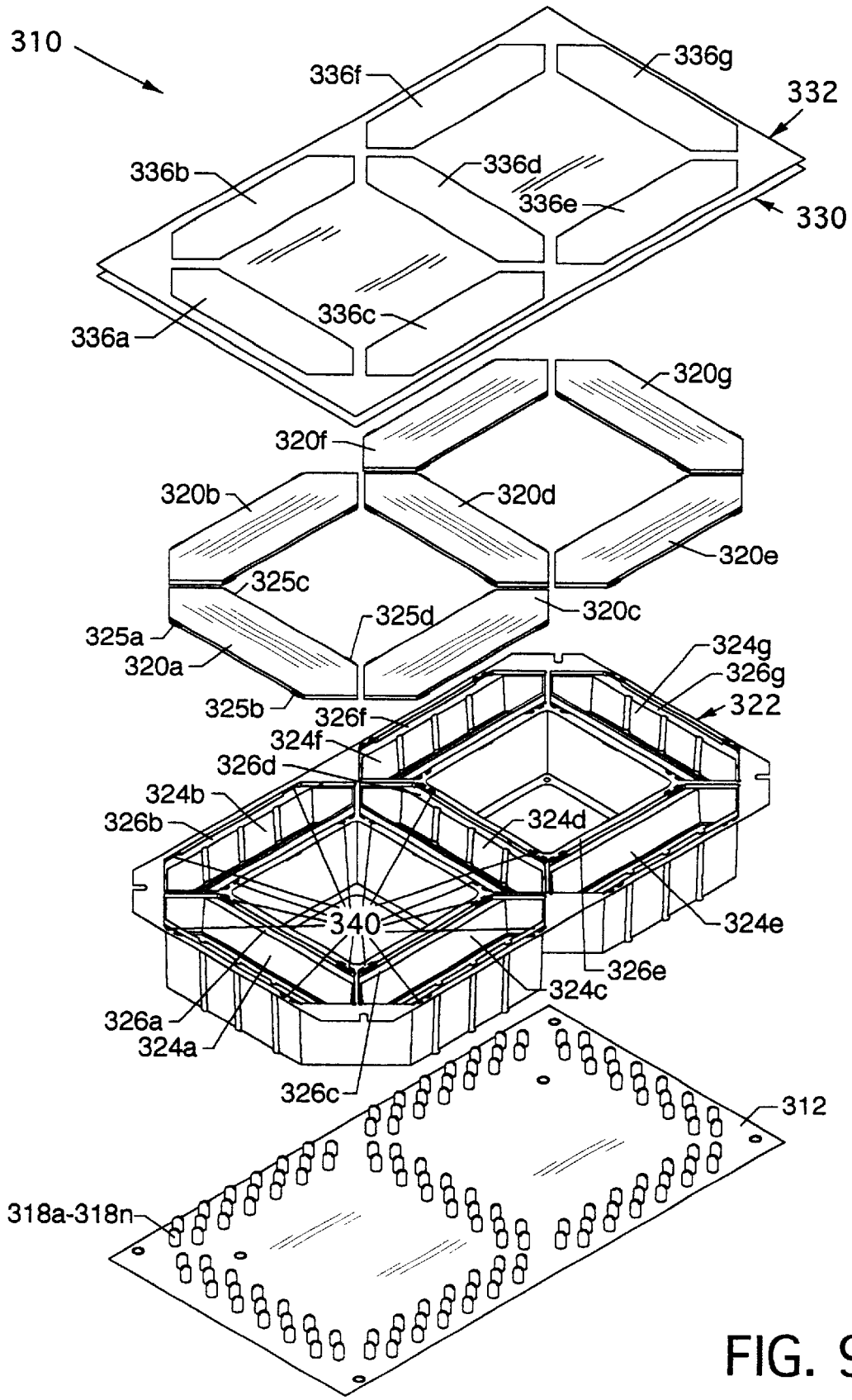
FIG. 9, a third alternative embodiment, illustrates an exploded isometric view of an LED lighted sign with individual light diffuser lenses having ramped tabs which align to and snappingly engage ramped tab receivers in the light divider assembly.
Figure 10:
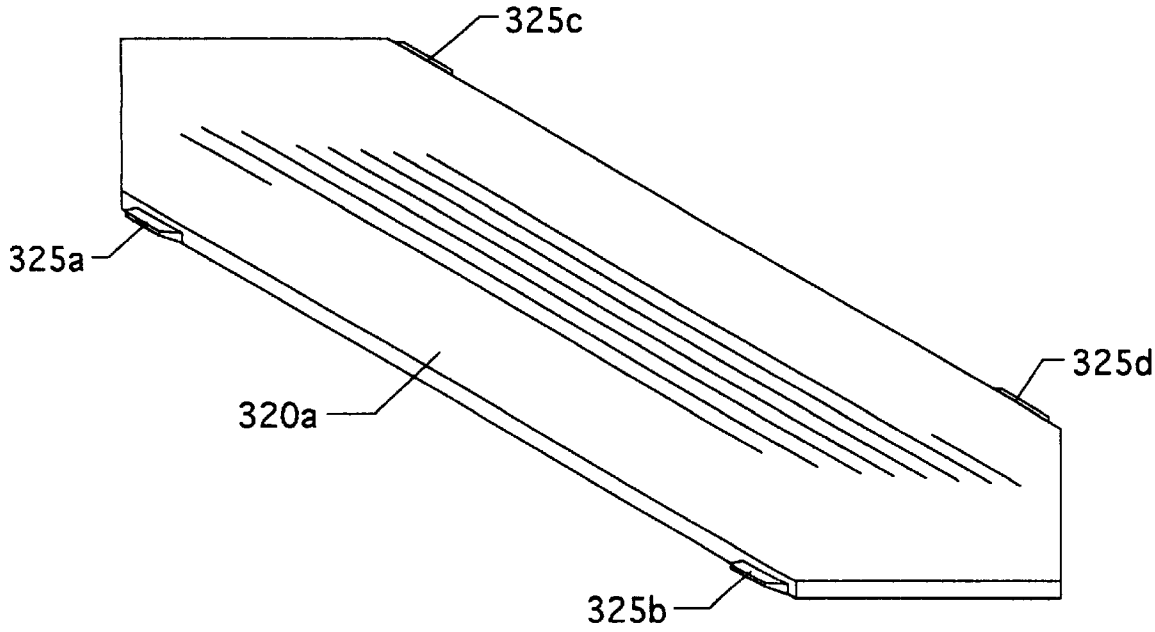
FIG. 10 illustrates an isometric view of a light diffuser lens having ramped tabs.

FIG. 9, a third alternative embodiment, illustrates an exploded isometric view of an LED lighted sign 310 with individual light diffuser lenses 320*a*–320*g* which align to segmented geometric chambers 324*a*–324*g*. The LED lighted sign 310 comprises a printed circuit board 312, a light divider assembly 322, preferably vacuum formed or extruded polymer material or molded of foam, plastic, metal or other suitable reflective or suitably colored material, and comprised of a plurality of segmented geometric chambers 324*a*–324*g*, a plurality of light diffuser lenses 320*a*–320*g* having a plurality of similarly shaped ramped tabs 325*a*–325*d* extending therefrom, as best shown in FIG. 10, a face plate 332 having a plurality of geometric cutouts 336*a*–336*g*, and a color filter 330. The printed circuit board 312 has a plurality of LEDs 318*a*–318*n* appropriately wired and secured thereto which align with the geometric chambers 324*a*–324*g*, respectively. The geometric chambers 324*a*–324*g* should be of molded or vacuum formed material preferably of a suitable color, such as gray or a shade of gray. LED color and brightness, along with the diffuser, also are factored into the color selection from the color spectrum for the chamber color. It is to be understood that any number of LEDs 318*a*–318*n* may be used to accommodate varying light intensity requirements. The light divider assembly 322 is comprised of seven individual geometric chambers 324*a*–324*g*, each having like components. A recess 326*a* is located along and about the upper region of the geometric chamber 324*a* to accommodate the light diffuser lens 320*a*. As also shown in FIG. 10, a plurality of ramped tabs 325*a*–325*d* extend horizontally from the major edges of the light diffuser lens 320*a* as well as being located on and extending in a similar fashion from each of the remaining light diffuser lenses 320*b*–320*g*. The ramped tabs 325*a*–325*d* of the light diffuser lens 320*a* snappingly engage a plurality of like ramped tab receivers 340 (FIG. 11) distributed and correspondingly located along and about the region adjacent the recess 326*a*. The light diffuser lens 320*a* aligns in the recess 326*a*, as shown in FIG. 12, and is flush with the upper surface of the light divider assembly 322. Similarly shaped recesses 326*b*–326*g* having ramped tab receivers 340 are located along and about the upper region of the geometric chambers 324*b*–324*g* to accommodate light diffuser lenses 320*b*–320*g* in a similar fashion. Geometric chambers 324*a*–324*g* of the light divider assembly 322 can be made by injection molding, casting, metal forming, welding, or other appropriate means.

Light diffuser lenses 320*a*–320*g* are now described in detail. The light diffuser lenses 320*a*–320*g*, which are individual members, can be injection molded or otherwise formed and are made of the same material as the light diffuser sheet 20 of the preferred embodiment. Optionally, the light diffuser lenses 320*a*–320*g* may be pigmented in the injection molding process to allow any color of light to be emitted. In the alternative, a light diffuser sheet 20 of the preferred embodiment can be placed over the upper surfaces of the light divider assembly 322 in substitution for the light diffuser lenses 320*a*–320*g*. The face plate 332 of the LED lighted sign 310 has seven geometric cutouts 336*a*–336*g* corresponding to the seven geometric chambers 324*a*–324*g* which mount to the printed circuit board 312 which allow light to pass through and create a numeric display when select geometric chambers 324*a*–324*g* are illuminated. The components of the LED lighted sign 310 may be assembled and secured, depending on the materials used, by nuts and bolts, screws, an appropriate adhesive, or welding.

FIG. 10 illustrates an isometric view of a light diffuser lens 320*a*. Each light diffuser lens 320*a*–320*g* preferably has four ramped tabs 325*a*–325*d* extending outwardly from the edge of the light diffuser lens, as exemplified by the light diffuser lens 320*a*.

Figure 11:
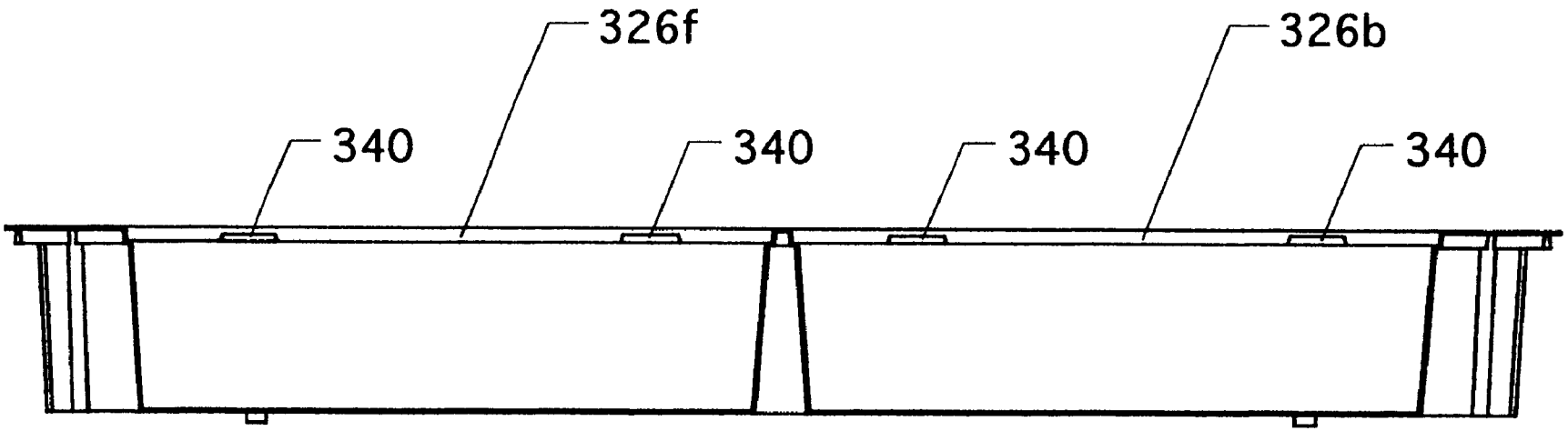
FIG. 11 illustrates a section view of the light divider assembly along line 11—11 of FIG. 12; and, FIG. 12 illustrates a front view of the light divider assembly, several light diffuser lenses, and a printed circuit board including the LEDs of FIG. 9.
Figure 12:
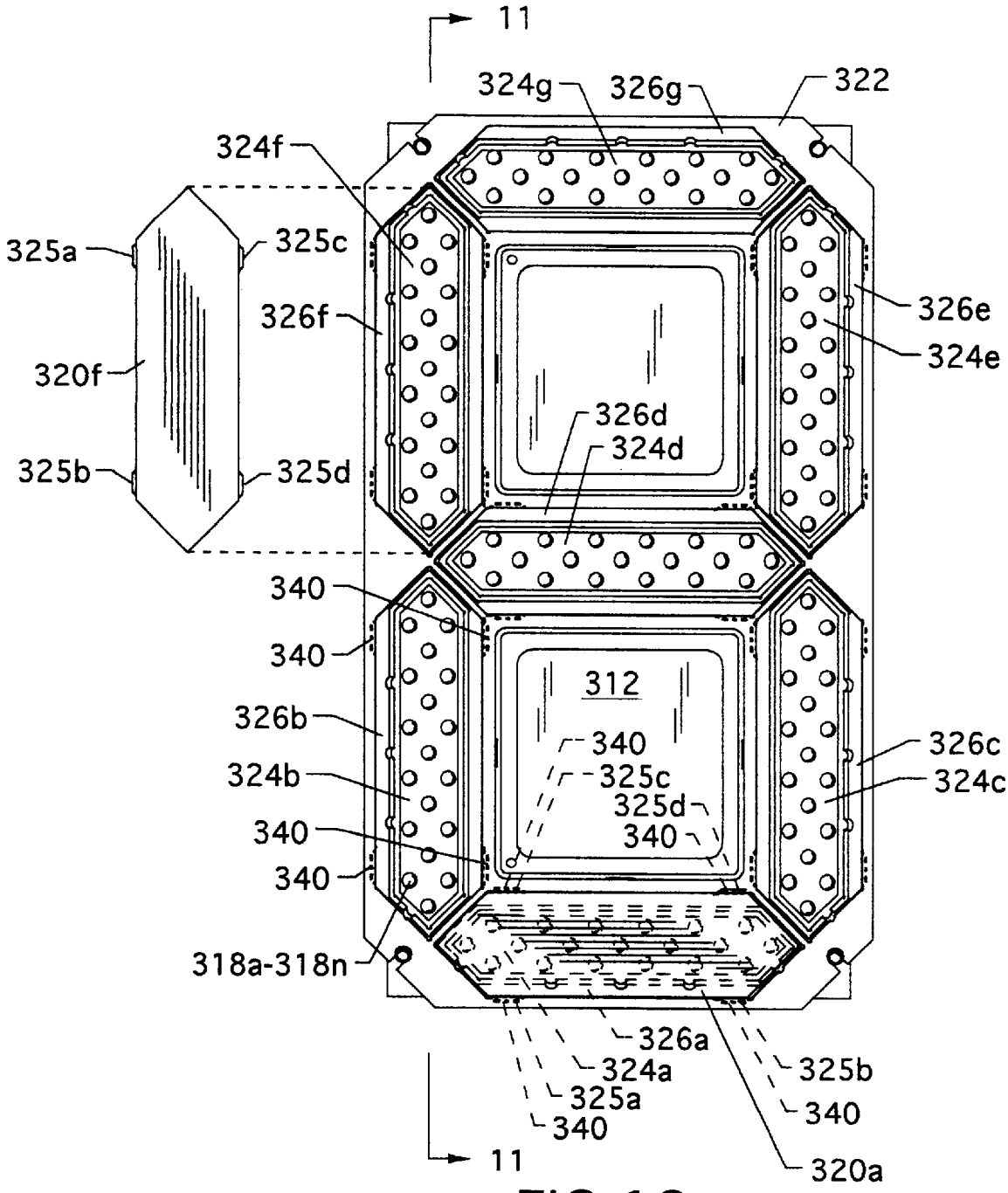

FIG. 11 illustrates a section view of the light divider assembly 322, light diffuser lenses 320*a* and 320*f*, along line 11—11 of FIG. 12. Illustrated in particular are the ramped tab receivers 340 located along and about the portions of the recesses 326*b* and 326*f* typifying in part the location of the ramped tab receivers 340 to the recesses 326*a*–326*g*.

FIG. 12 illustrates a front view of the light divider assembly 322 and printed circuit board 312 including LEDs 318*a*–318*n* aligned respectively in geometric chambers 324*a*–324*g*. Shown in particular are the recesses 326*a*–326*g* located along and about the vertical regions of the geometric chambers 324*a*–324*g*, respectively, for accommodation of the light diffuser lenses 320*a*–320*g*. Light diffuser lens 320*a* in particular is shown in engagement with the geometric chamber 324*a* where snapping engagement of the ramped tabs 325*a*–325*d* with the appropriate aligned ramped tab receivers 340 has occurred. Also shown is the alignment of the LEDs 318*a*–318*n* extending upwardly from the printed circuit board 312 into the respective geometric chambers 324*a*–324*g*.

MODE OF OPERATION

With reference to FIGS. 1–3, the mode of operation is now described, where all numerals correspond to those elements previously described. LEDs 18*a*–18*n* are soldered onto the upper surface of PC board 12. Once the LEDs 18*a*–18*n* are appropriately soldered, the apertures 34*a*–34*n* of the light divider assembly 22 are positioned over and about the corresponding LEDs 18*a*–18*n* of PC board 12. The light diffuser sheet 20 is then positioned over the light divider assembly 22. A color filter 30 of any desired color may then be positioned over the light diffuser sheet 20. It is to be understood that a color filter 30 is not necessary if no color display is desired. Face plate 32 is then positioned over the color filter 30 and the light diffuser sheet 20. The rectangular lip 38 of the face plate 32 fits about the outside perimeter of the light divider assembly 22 which is suitably secured to the PC board 12.

With reference to FIGS. 4–6, the mode of operation is similar to that of the preferred embodiment, with the exception that the geometric chambers 124*a*–124*g* of the light divider assembly 122 must first be aligned and configured, as illustrated, and snappingly engaged to the PC board 112. In the first alternative embodiment, light diffuser lenses 120*a*–120*g* are substituted for the light diffuser sheet 20 and are injection molded of the same light diffusing material.

With reference to FIGS. 7–8, the mode of operation is similar to that of the preferred embodiment, with the exception that individual light diffuser lenses 220*a*–220*g* are substituted for the light diffuser sheet 20 and are accommodated by the recesses 226*a*–226*g* in the geometric chambers 224*a*–224*g* and are injection molded of the same light diffusing material previously described. The LEDs 218*a*–218*n* project upwardly and directly into the geometric chambers 224*a*–224*g* without passing through any other apertures.

With reference to FIGS. 9–12, the mode of operation is similar to that of the preferred embodiment, with the exception that individual light diffuser lenses 320*a*–320*g* are substituted for the light diffuser sheet 20 and are accommodated by the recesses 326*a*–326*g* in the geometric chambers 324*a*–324*g* and are injection molded of the same light diffusing material previously described. Also included in each of the light diffuser lenses 320*a*–320*g* are ramped tabs 325*a*–325*d* which, during installation, force the sides of the individual geometric chambers 324*a*–324*g* and outside edges of the recesses 326*a*–326*g* outwardly for snapping engagement with the ramped tab receivers 340. The LEDs 318*a*–318*n* project upwardly and directly into the geometric chambers 324*a*–324*g* without passing through any other apertures.

Various modifications can be made to the present invention without departing from the apparent scope hereof.

It is claimed:

1. A lighted alpha-numeric display assembly, comprising:

a. a printed circuit board;

b. a light divider assembly mounted on said printed circuit board, said light divider assembly comprising a plurality of partitions upstanding from said printed circuit board, said partitions forming seven geometric chambers of identical shape arranged in the form of a figure eight, each of said seven geometric chambers having an open top, and each of said seven geometric chambers further having a plurality of outwardly protruding tabs adjacent to its open top;

c. light emitting diodes associated with said printed circuit board and extending therefrom into said seven geometric chambers for providing illumination in each of said seven geometric chambers, there being a plurality of said light emitting diodes received in each of said seven geometric chambers;

d. separate light diffuser lenses corresponding in shape to the shape of said seven geometric chambers, said light diffuser lenses covering said open tops of said seven geometric chambers, each light diffuser lens having downwardly extending tab receivers corresponding in number to the plurality of outwardly protruding tabs of each of said seven geometric chambers, each tab receiver receiving one of said outwardly protruding tabs; and, e. a face plate arranged over said light diffuser lenses and secured to said light divider assembly, said face plate having seven geometric cutouts corresponding in shape to the shape of said seven geometric chambers and light diffuser lenses, and said seven geometric cutouts being in alignment with said seven geometric chambers and light diffuser lenses.

2. The lighted alpha-numeric display assembly as defined in claim 1, wherein said light emitting diodes are oval in shape with varying beam spread in two directions, which allows positioning of the light emitting diodes to distribute light in the most efficient manner to achieve uniform lighting within each of said seven geometric chambers.

3. The lighted alpha-numeric display assembly as defined in claim 1, wherein each of said seven geometric chambers has flexible locking tabs extending downwardly therefrom, and wherein said printed circuit board has apertures into which said flexible locking tabs are snappingly engaged.

4. The lighted alpha-numeric display assembly as defined in claim 1, wherein said face plate is planar and has upper and lower surfaces, and wherein said light diffuser lenses are received in said seven geometric cutouts of said face plate and extend up to or above said upper surface of said face plate.

5. The lighted alpha-numeric display assembly as defined in claim 1, wherein each light diffuser lens has high transmittance lighting output ratio, low diffusion-haze, light stability, and high service temperature withstand ability and is composed of an acrylic polymer having a first refractive index into which is incorporated spherical, high molecular weight polymer beads having a refractive index different from said first refractive index.

6. A lighted alpha-numeric display assembly, comprising:

a. a printed circuit board;

b. a light divider assembly mounted on said printed circuit board, said light divider assembly comprising a one-piece, unitary member having walls forming seven geometric chambers of identical shape arranged in the form of a figure eight, each of said seven geometric chambers having an upper surface, an open top, and a recess around the entire perimeter thereof adjacent to the open top;

c. light emitting diodes associated with said printed circuit board and extending therefrom into said seven geometric chambers for providing illumination in each of said seven geometric chambers, there being a plurality of said light emitting diodes received in each of said seven geometric chambers;

d. separate light diffuser lenses corresponding in shape to the shape of said seven geometric chambers, said light diffuser lenses being disposed in said recesses around the perimeters of said seven geometric chambers, covering said open tops of said seven geometric chambers, and lying flush with said upper surfaces of said seven geometric chambers; and, e. a face plate arranged over said light diffuser lenses and secured to said light divider assembly, said face plate having seven geometric cutouts corresponding in shape to the shape of said seven geometric chambers and light diffuser lenses, and said seven geometric cutouts being in alignment with said seven geometric chambers and light diffuser lenses.

7. The lighted alpha-numeric display assembly as defined in claim 6, wherein each light diffuser lens has high transmittance lighting output ratio, low diffusion-haze, light stability, and high service temperature withstand ability and is composed of an acrylic polymer having a first refractive index into which is incorporated spherical, high molecular weight polymer beads having a refractive index different from said first refractive index.

8. The lighted alpha-numeric display assembly as defined in claim 6, and further comprising a color filter in the form of a single, unitary sheet disposed between said light diffuser lenses and said face plate and extending across all of said light diffuser lenses.

9. The lighted alpha-numeric display assembly as defined in claim 6, wherein each of said light diffuser lenses has a number of ramped tabs extending outwardly along edges thereof, and wherein each of said recesses around the perimeters of said seven geometric chambers has a like number of ramped tab receivers communicating therewith into which said ramped tabs extend.

10. The lighted alpha-numeric display assembly as defined in claim 6, wherein said light divider assembly is gray or a shade of gray in color.

* * * * *